US006203247B1

(12) United States Patent
Schellstede et al.

(10) Patent No.: US 6,203,247 B1
(45) Date of Patent: Mar. 20, 2001

(54) DRILLING VESSEL WITH MOVEABLE SUBSTRUCTURE

(76) Inventors: Herman J. Schellstede, 109 Bridge St., New Iberia, LA (US) 70560; Rodney Verret, 1186 Grand Bois Rd., Parks, LA (US) 70582

( * ) Notice: Subject to any disclaimer, the term of this patent is extended or adjusted under 35 U.S.C. 154(b) by 0 days.

(21) Appl. No.: 09/210,262

(22) Filed: Dec. 10, 1998

(51) Int. Cl.[7] ..... B63B 35/44
(52) U.S. Cl. ..... 405/196; 405/203
(58) Field of Search ..... 405/196, 195.1, 405/204, 203, 207, 208

(56) References Cited

U.S. PATENT DOCUMENTS 3,183,676 * 5/1965 Le Tourneau ..... 405/196
3,201,945 * 8/1965 Sutton ..... 405/196
4,065,934 * 1/1978 Dysarz ..... 405/196
4,288,177 * 9/1981 Schoonmade ..... 405/196
4,445,805 * 5/1984 Ray et al. ..... 405/203 X
4,487,526 * 12/1984 Struve et al. ..... 405/196
4,602,894 * 7/1986 Lorenz et al. ..... 175/7 X
5,492,436 * 2/1996 Suksumake ..... 405/201

* cited by examiner

*Primary Examiner*—Eileen D. Lillis
*Assistant Examiner*—Frederick L. Lagman
(74) *Attorney, Agent, or Firm*—Jesse D. Lambert

(57) ABSTRACT

A drilling vessel is provided for selectively drilling two or more wells from a single location of the vessel, comprising a buoyant hull having a deck, including ballasting devices in the hull for allowing the vessel to be stabilized on the bottom surface of a body of water; a movable substructure in contact with the deck, wherein the movable substructure includes a drilling platform having a plurality of downwardly extending support legs attached thereto, wherein the height of the drilling platform from the deck is sufficient to allow simultaneous drilling and production activities to occur; and a repositioning system, operatively connected between the support members and the deck, for moving the drilling platform in a predetermined direction relative to the deck. In a preferred embodiment, a plurality of lift and roll jacks are employed beneath each level of a two-tiered repositioning system such that the substructure may be moved in both a transverse and a longitudinal direction. In this manner, multiple wells may be drilled without relocating the vessel, while allowing maintenance activities to occur on previously drilled wells.

28 Claims, 8 Drawing Sheets

11
11
35
47
48
46
44,45
47
37
48
41,42
36
43
20,22
43
16
19,21
38

10

11
11
49
44
45
48
41
48
47
42
47
15
43
14
43
16
13
43
43

DRILLING VESSEL WITH MOVEABLE SUBSTRUCTURE

BACKGROUND OF THE INVENTION

I. Field of the Invention

The present invention relates generally to apparatuses for the drilling of oil and gas wells from barges or other vessels, and more particularly to drilling substructures which can be moved to drill two or more wells without relocation of the barge.

II. Description of Prior Art

In the oil and gas industry, the terrain above the suspected location of hydrocarbon products is largely determinative of the type of machinery used to drill the necessary wells. Onshore drilling operations generally require the least amount of preparation and expense, whereas as deep offshore locations typically require massive underwater frames to support the drilling operations above the water. In most cases, the drilling platform is relatively stationary. However, there are many instances, such as in lakes, swamps and other shallow water areas, in which the terrain allows for the use of barge drilling vessels. The two major classes of drilling barges are bay (or swamp) barges and posted barges. Both types of drilling barges are self-contained drilling systems which can be floated to a desired location by a tugboat or similar means and caused to be stabilized with respect to the ground. In the case of posted barges, three or more vertical posts are jacked downwardly into the mud below the surface of the water until the entire barge and its associated drilling platform are stabilized. In the case of bay barges, the ballasting system of the barge is manipulated until the bottom of the barge rests firmly on the bottom of the river or bay. In either type of drilling barge, once the barge is properly stabilized, the derrick is hingeably raised to its operating position, and the well can then be drilled through a keyway formed into the drilling barge below the drilling platform. After the well is drilled, the barge is moved away from the site so that other activities related to production and completion of the well can be conducted. In this manner, the barge can be moved relatively easily from one drilling site to the next by simply floating it to another location. However, there are distinct disadvantages to the requirement of moving the barge in order to drill another well.

Moving the barge requires complete cessation of drilling activities, lowering the derrick, and conducting numerous preparatory tasks prior to moving the vessel. Of course, the entire drilling system must again be placed into its operational configuration once the barge is relocated, consuming even greater time and expense prior to the actual drilling process. In addition to concerns over time and expense, relocation of the barge is sometimes impossible or ill advised, depending upon the underlying terrain or numerous other factors. A particularly poignant example of a situation in which relocation of the barge would be undesirable is in drilling operations in certain parts of Nigeria. Many of the drilling sites in that country are along small rivers and streams having exceedingly soft bottoms. The narrow spaces within which the barge must operate make it difficult to reposition the barge for each well to be drilled. Also, the soft river bottoms require more careful and time-consuming ballasting and deballasting of the vessel than in other environments to ensure a stable platform for the drilling operations. Relocation of the barge under these conditions, therefore, is at best an expensive undertaking, and at worst an impossible task.

Finally, the need for frequent relocation of the barge makes it difficult to maintain an adequate security perimeter around the barge. In Nigeria, as well as in other third world countries experiencing political unrest, such drilling operations are a frequent target of vandalism and terrorism. Consequently, it is often necessary to construct fences or barricades around the barge to prevent unauthorized access to the drilling equipment and personnel. Such security measures must often be dismantled and reconstructed during the relocation of the barge, thereby jeopardizing valuable equipment and crew members during these windows of vulnerability.

Based upon the aforementioned problems associated with relocation of the barge, there is a distinct need in the industry for a barge drilling system which would permit the drilling of two or more wells while the barge remains stabilized at a single location. In such a proposed system, the barge would remain in a particular location, while the drilling substructure is moved relative to the barge to drill one or more wells in a pattern. Ideally, after a first well is drilled, production and completion operations can be conducted on the first well, simultaneous with the drilling of a second or subsequent well adjacent to the first drilled well. The movable substructure would include a hoisting system suspended from underneath the drill floor, as well as a skate system at the base of the substructure, for easily moving heavy equipment, such as blow out preventers (BOP's) to and from the wells that have been drilled. Because the barge would remain situated during the maintenance of previously drilled wells, a protective deck would also be employed above the well protect structure for use by crews around those wells undergoing production.

SUMMARY OF THE INVENTION

Therefore, it is an object of the present invention to provide a movable substructure for use in drilling wells which includes the capability to reposition the horizontal location of the substructure relative to a stationary base.

It is also an object of the present invention to provide a movable substructure for use in drilling which allows the drilling of two or more wells without requiring a relocation of the stationary base.

It is a further object of the present invention to provide a movable substructure for use in drilling which can be used in connection with a drilling barge or other buoyant vessel.

Another object of the present invention is to provide a movable substructure for drilling that is sufficient in height to allow for simultaneous drilling of one well during the maintenance of one or more previously drilled wells.

A further object of the present invention is to provide a movable substructure for drilling that includes a clamping system for securing the position of the movable substructure relative to the stationary base between repositioning steps.

Still another object of the present invention is to provide a drilling barge having reinforcing structural components to accommodate the shifting weight of the movable substructure between the drilling of two or more wells.

Another object of the present invention is to provide a drilling barge having a keyway sufficient in structure and dimension to allow the drilling of at least six wells.

These and other objects and advantages of the present invention will no doubt become apparent to those skilled in the art after having read the following description of the preferred embodiments which are contained in and illustrated by the various drawing figures.

Therefore, in a preferred embodiment, a drilling vessel for selectively drilling two or more wells from a single location of said vessel is provided, comprising a buoyant hull having a deck, including ballasting means in the hull for allowing the vessel to be stabilized on the bottom surface of a body of water; a movable substructure in contact with the deck, wherein the movable substructure includes a drilling platform having a plurality of downwardly extending support legs attached thereto, wherein the height of the drilling platform from the deck is sufficient to allow simultaneous drilling and production activities to occur, and repositioning means, operatively connected between the support members and the deck, for moving the drilling platform in a predetermined direction relative to the deck. In a preferred embodiment, the repositioning means comprises a transverse repositioning device for movement of the drilling platform in a port or starboard direction, and a longitudinal repositioning device for movement of the drilling platform in a bow or stem direction. Furthermore, in a more preferred embodiment, the longitudinal repositioning device is connected to the support legs of the drilling platform, and it resides above and moves relative to the transverse repositioning device.

The transverse repositioning device includes at least two horizontal and parallel transverse beams in contact with the deck, while the longitudinal repositioning device includes at least two horizontal and parallel longitudinal beams connected to opposing pairs of the support legs of the drilling platform, wherein the longitudinal beams are parallel to and in contact with the transverse beams. The transverse repositioning device includes a plurality of lift and roll transverse jacking assemblies operatively in contact between the transverse beams and the deck, while the longitudinal repositioning device includes a plurality of lift and roll longitudinal jacking assemblies operatively in contact between the longitudinal beams and the transverse beams.

Preferably, each of said transverse jacking assemblies includes a mounting portion in contact with the deck; a jacking element connected to the mounting portion, wherein the jacking element is adapted to lift the transverse beam in a vertical direction away from the deck; a rolling element connected to the jacking element; and a force applying element, such as a hydraulically powered ram, connected to the mounting portion adapted to move the transverse beam over the rolling element relative to the jacking assembly when the transverse beam is lifted by the jacking element. Similarly, each of the longitudinal jacking assemblies includes a mounting portion in contact with an upper surface of the transverse beam; a jacking element connected to the mounting portion, wherein the jacking element is adapted to lift the longitudinal beam in a vertical direction away from the transverse beam; a rolling element connected to the jacking element; and a force applying element, such as a hydraulically powered ram, connected to the mounting portion adapted to move the longitudinal beam over the rolling element relative to the jacking assembly when the longitudinal beam is lifted by the jacking element.

The drilling vessel further comprises two or more platens constructed onto the deck beneath the repositioning means, wherein the platens are sized and dimensioned to provide a bearing surface for the drilling platform and the transverse beams, and wherein each of the platens includes a first horizontally extending flange. A second set of horizontally extending flanges are also connected to each of the transverse beams.

Also provided are transverse clamping means operatively connected to the transverse beams and matably engageable with the first horizontally extending flanges of the platens for securing the position of the transverse beams relative to the deck between repositioning operations; as well as longitudinal clamping means operatively connected to the longitudinal beams and matably engageable with the second horizontally extending flanges of the transverse beams for securing the position of the longitudinal beams relative to the transverse beams between repositioning operations.

For reinforcement purposes, the hull of the drilling vessel further includes a plurality of support members rigidly connected within the hull below the movable substructure, such that the support legs of the drilling platform reside directly above the support members at any position of the movable substructure relative to the deck. As is common, a keyway is also formed into the hull, but is sized and dimensioned to allow the drilling of multiple well locations corresponding to the position of the movable substructure. Finally, in order to move heavy equipment, such as BOP's and other supplies, the vessel also includes skating means constructed onto the deck and adjacent to the keyway for transporting equipment to and from a desired well. In a preferred embodiment, the skating means comprises a track member fixed relative to the deck and parallel to the keyway; a carrier matably engaged to the track member; and rolling means disposed between the track member and the carrier for enabling smooth movement of the carrier relative to the track member.

DETAILED DESCRIPTION OF THE PREFERRED EMBODIMENTS

Figure 1:
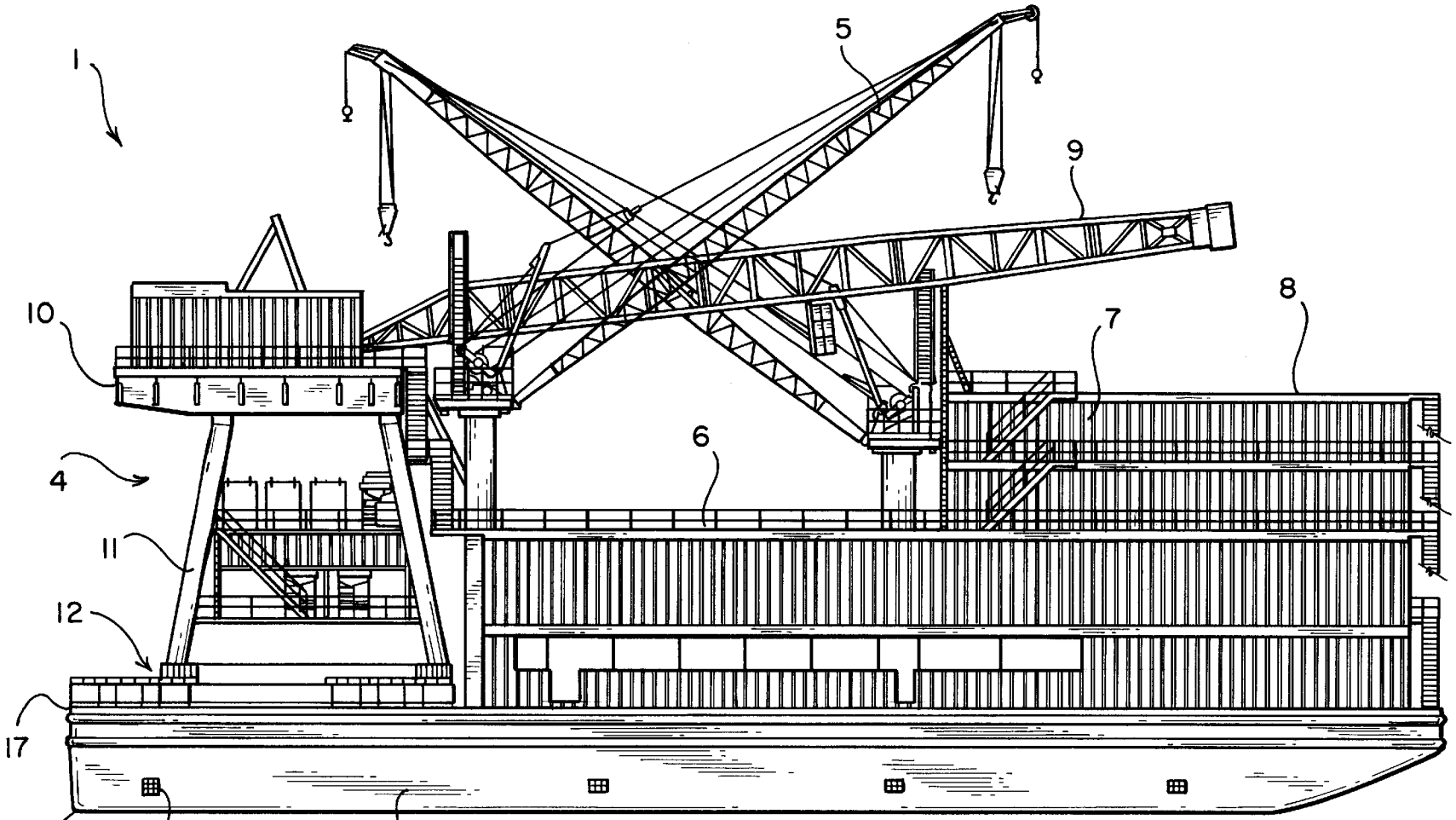
FIG. 1 is an overall elevation view of a typical bay barge using the present invention, and generally depicting the movable substructure.

Turning now to FIG. 1, a modified bay barge 1 is shown to generally comprise a lower hull 2, a plurality of sea chests and ballasting chambers 3, a movable substructure 4 located at the stern of the barge 1, one or more cranes 5, a pipe rack area 6, crew living quarters 7, a helipad 8, and a derrick 9. The movable substructure 4 includes a drill floor 10, support legs 11, and a lift and roll jacking system 12 which will be described in greater detail below.

Figure 2A:
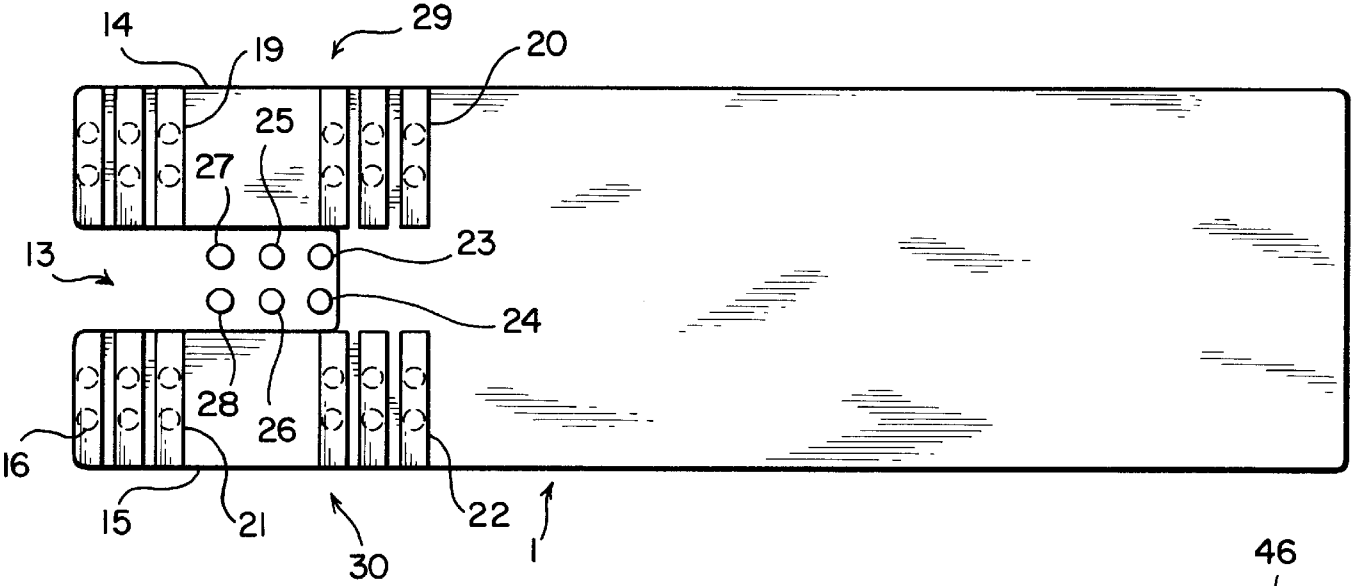
FIG. 2A is an overall top view of the bay barge of FIG. 1 depicting the location of the reinforcement columns and platens for the movable substructure.

FIG. 2A is a top view of the barge 1 with most of the other components omitted for clarity. A keyway 13 through which drilling operations are conducted is located at the stem of the barge 1 and is defined by the space between two parallel extending portions 14,15 of the hull. In order to support the shifting weight of the movable substructure 4 in each of its multiple positions, barge 1 is reinforced by a plurality of vertical steel columns 16 connected, such as by welding, between the deck 17 and the bottom 18 of the barge 1. In the embodiment of the invention shown in the figures, a total of six different wells may be drilled without relocation of the barge 1. Therefore, a total of twenty-four (24) vertical columns 16 are employed, such that each of the four support legs 11 of the movable substructure 4 are directly above a column 16 when the movable substructure 4 is in a desired position, as will be further explained below. For further reinforcement, and to provide a bearing surface for the jacking system 12 and the movable substructure 4, three sets of four platens 19–22 are also attached to the deck 17 above each pair of columns 16. For example, platens 19–22 serve as the primary bearing surface for the substructure 4 when the drilling is to be accomplished at points 23 or 24 of the drill pattern shown in FIG. 2A. Similarly, each of the other pairs of drilling points 25,26 and 27,28 are defined by the presence of the substructure 4 over the next successive groups of platens as the substructure 4 is repositioned toward the stem of the barge 1. If the substructure 4 is repositioned on the port side 29, drilling points 23,25,27 are accessible. If the substructure 4 is repositioned on the starboard side 30, drilling points 24,26,28 are likewise accessible.

Figure 2B:
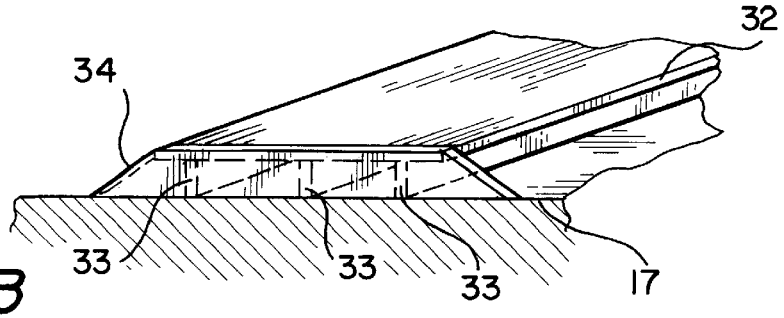
FIG. 2B is a detailed view of the platens which support the movable substructure.

FIG. 2B illustrates the manner in which each of the platens is constructed. A steel horizontal plate 32 is supported by several vertical plates 33 which are preferably welded between horizontal plate 32 and deck 17. Opposing end plates 34 are also preferably welded to horizontal plate 32, vertical support plates 33 and deck 17 to create a strong reinforcing support platform over which the movable substructure 4 may rest.

Figure 3B:
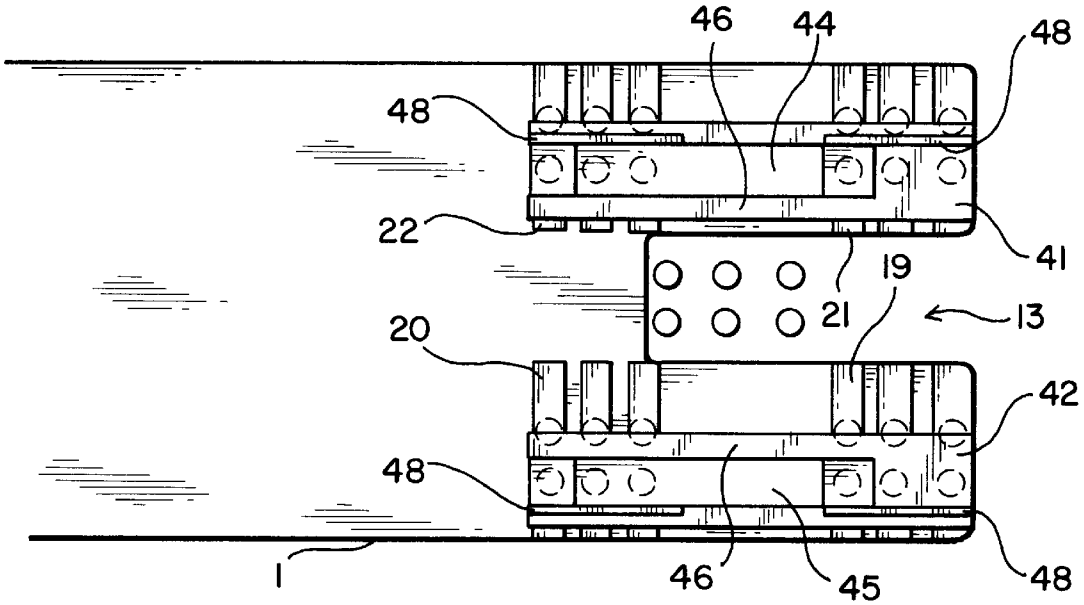
FIG. 3B is a top view of FIG. 3A.
Figure 3A:
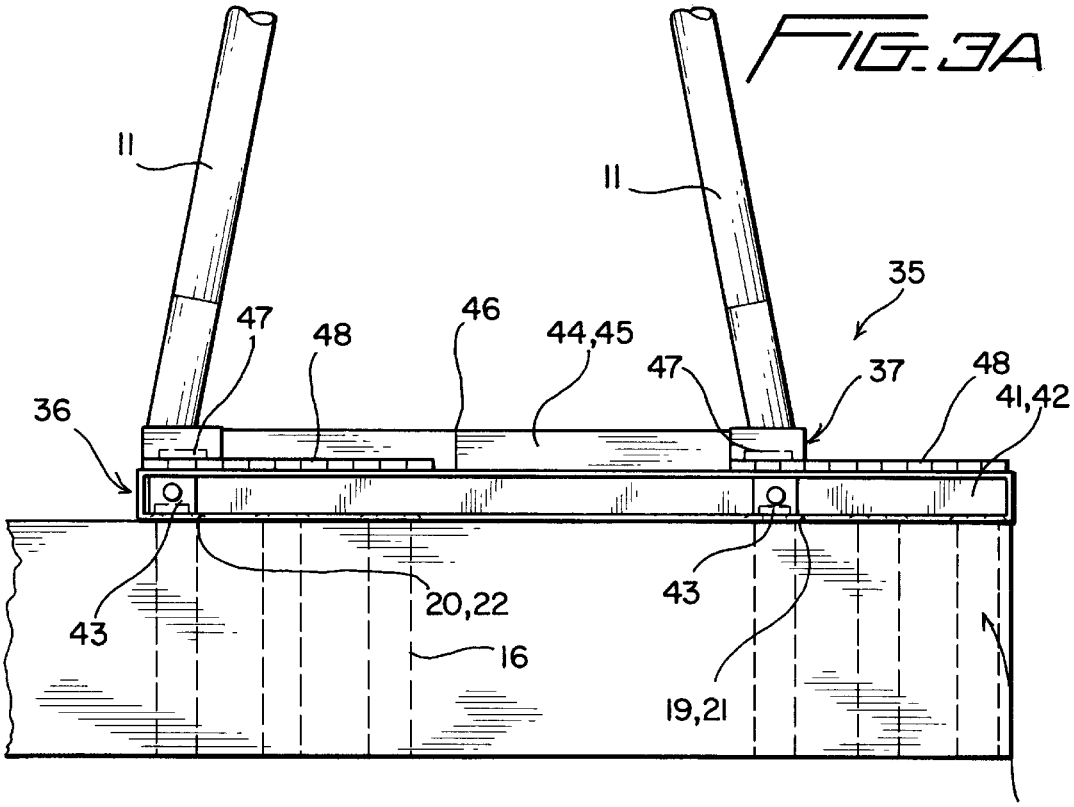
FIG. 3A is a more detailed side view of the movable substructure, including the relationship between the port/starboard movement and the bow/stem movement.
Figure 4:
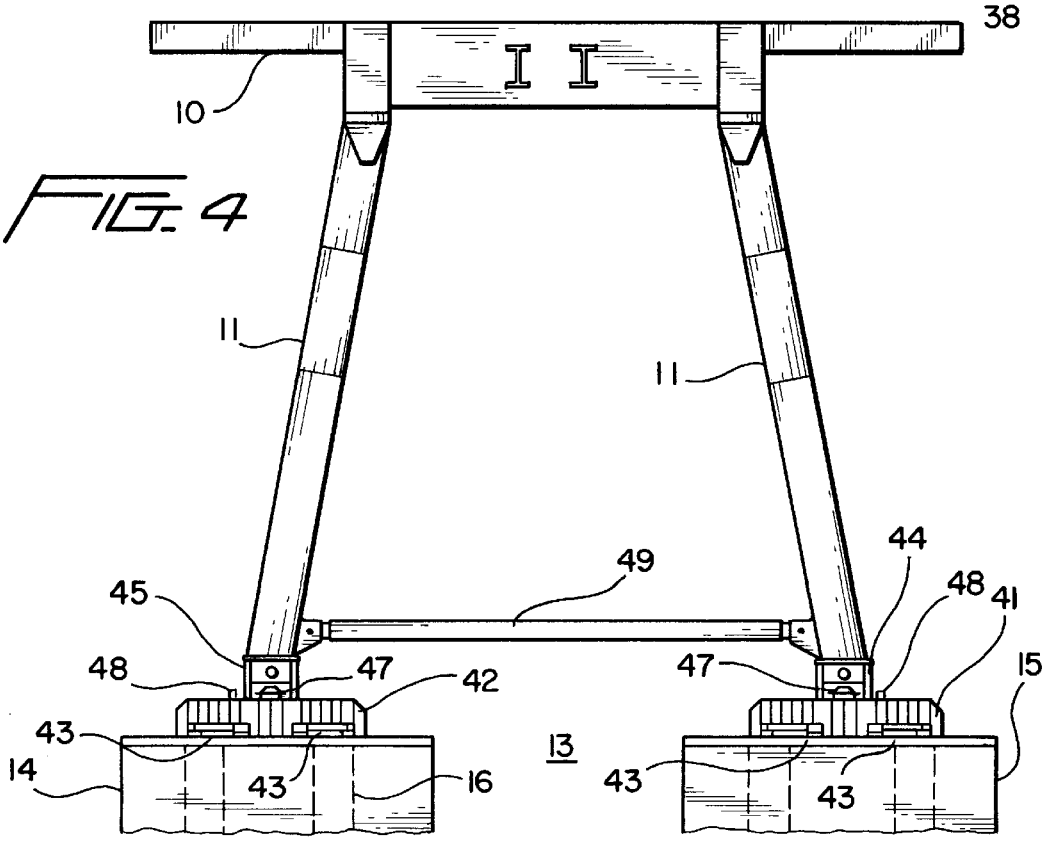
FIG. 4 is a rear view of the movable substructure shown in FIG. 3A, looking from the stern of the barge.

FIG. 3A is a side view illustrating the main components of the repositioning means 35 of the movable substructure 4 which permit motion in the bow/stem direction and in the port/starboard direction. FIG. 3B is a top view of the repositioning means 35, wherein the support legs 11 and other components of the substructure 4 are omitted for clarity. FIG. 4 is a rear view of the invention, looking from the stern of the barge 1. The movable substructure 4 is always at the stem 38 of the barge 1. In a preferred embodiment, repositioning means 35 generally comprises a transverse repositioning device 36 for movement of the drilling platform 10 in a port or starboard direction, as well as a longitudinal repositioning device 37 for movement of the drilling platform 10 in a bow or stern direction. In FIG. 3A, the longitudinal repositioning device 37 is connected to the support legs 11 of the drilling platform 10 and resides above and moves relative to the transverse repositioning device 36. The transverse repositioning device 36 is disposed between the longitudinal repositioning device 37 and the deck 17. Therefore, when the transverse repositioning device 36 is caused to move, the entire movable substructure 4 and the longitudinal repositioning device 37 are moved in a port or starboard direction. When the longitudinal repositioning device 37 is caused to move, the entire movable substructure 4 is moved in a bow or stem direction, but the transverse repositioning device 36 remains stationary.

Referring collectively to FIGS. 3A, 3B and 4, transverse repositioning device 36 comprises a pair of horizontal and parallel walking beams 41,42 which are in contact with the platens 19–22 on deck 17. A plurality of lift and roll transverse jack assemblies 43 are operatively disposed beneath transverse walking beams 41,42 and are used to move transverse walking beams 41,42 in a manner to be explained in further detail below. Longitudinal repositioning device 37 also comprises a pair of horizontal and parallel walking beams 44,45 which are in contact with the upper surface 46 of transverse walking beams 41,42. A plurality of lift and roll longitudinal jack assemblies 47 are operatively disposed beneath longitudinal walking beams 44,45 and are used to move longitudinal walking beams 44,45 in a manner to be explained in further detail below. Outboard jacking system supports 48 are also connected to transverse walking beams 41,42 and provide sliding or rolling contact with longitudinal walking beams 44,45, thereby serving as a guide for longitudinal walking beams 44,45 as they move in a bow or stem direction. Also, shown in FIG. 4 is a removable support strut 49 connected between opposing support legs 11, which provides additional bracing of the substructure 4 during drilling and maintenance operations. Support strut 49 is removably connected to support legs 11 by a common pin and clevis arrangement or similar fastening hardware known to those in the art.

Figure 5A:
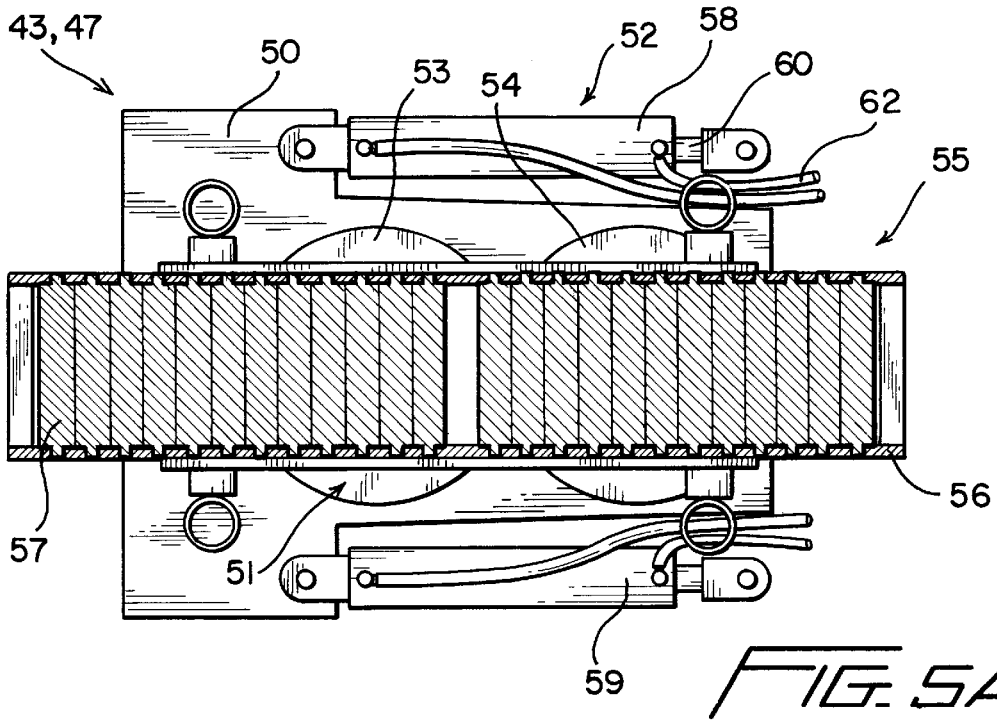
FIG. 5A is top view of a preferred embodiment of the lift and roll jacks used to reposition the movable substructure of the present invention.
Figure 5B:
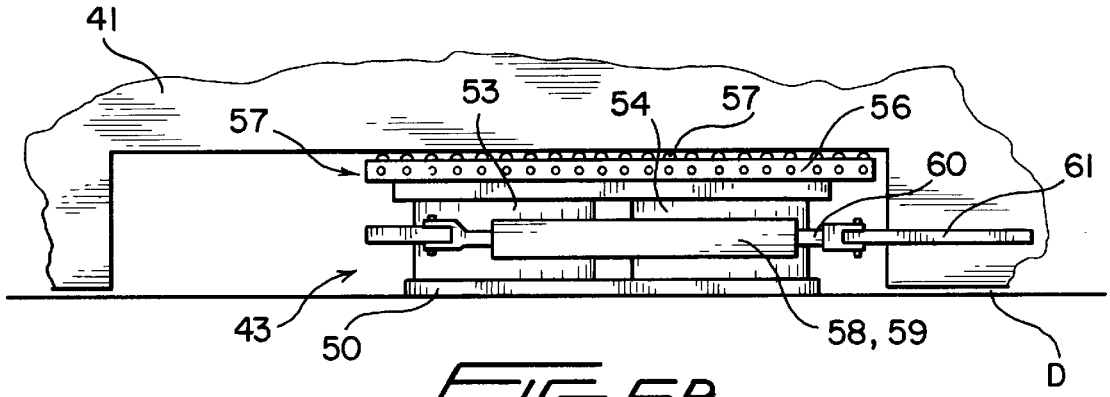
FIGS. 5B and 5C are side views of the lift and roll jacks of FIG. 5A in position beneath one of the port/starboard walking beams of the movable substructure.
Figure 5C:
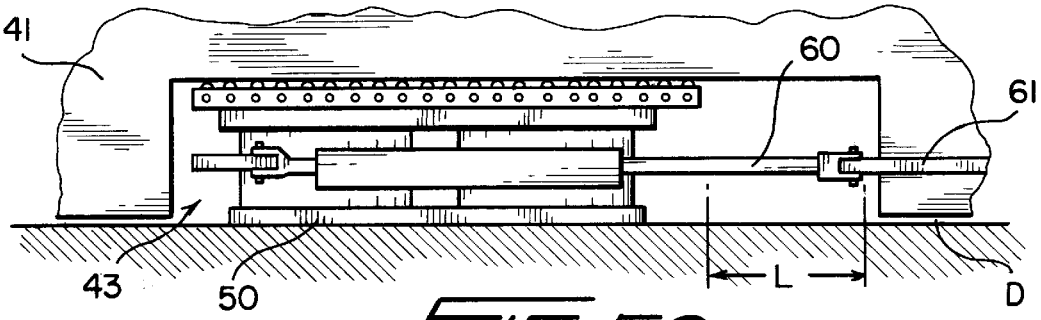

FIGS. 5A, 5B and 5C represent top, side and end views, respectively, of the lift and roll jacks 43,47 which provide the motive force for both the transverse repositioning device 36 and the longitudinal repositioning device 37, respectively. Each of the jacks includes a base 50 having a vertical hydraulically controlled jacking device 51 and a horizontal hydraulically controlled jacking device 52. Vertically controlled jacking device 51 preferably comprises a pair of jacking cylinders 53,54 which support a rolling rack 55. Rolling rack 55 will typically comprise a frame 56 having a plurality of rollers 57 which contact the applicable walking beam during a repositioning operation. As will be further illustrated, rolling rack 55 is raised by jacking cylinders 53,54 prior to each move and lowered immediately after each move. Horizontally controlled jacking device 52 preferably comprises a pair of jacking cylinders 58,59 pivotally connected to opposite sides of the base 50, wherein each of the jacking cylinders 58,59 includes a ram 60 connectable to a plate 61 extending from the walking beam in question. Suitable hydraulic lines 62 extend from each of jacking cylinders 53,54,58,59 so that the motion in both directions can be controlled in a manner commonly known to those in the industry.

As shown more clearly in FIGS. 5B and 5C, horizontal jacking cylinders 58,59 are used to push or pull walking beam 41 during each repositioning operation. In the following figures, a transverse walking beam 41 is shown, with understanding that the same arrangement exists for longitudinal walking beams 44,45. In FIG. 5B, a lift and roll jack 43 is shown positioned beneath a walking beam 41 just prior to moving the substructure 4. Note that the vertical jacking cylinders 53,54 have already lifted the rolling rack 55 into contact with the walking beam 41, such that the walking beam 41 is raised a distance D approximately one inch or less above the platens. When actuated, the horizontal jacking cylinders 58,59 push against the plate 61 to which the ram 60 is connected, resulting in the movement of walking beam 41 over the rolling rack 57 as the lift and roll jack 43 remains stationary with respect to the platens. At the completion of the move, shown in FIG. 5C, the walking beam 41 has traveled over a length L, roughly corresponding to the length of the ram 60. Once the horizontal motion has ceased, the vertical jacking cylinders 53,54 are lowered, which allows the walking beam 44 to rest once again on the platens as the rolling rack 55 breaks contact with the walking beam 41. Now that the lift and roll jacks 43 are no longer supporting the weight of the substructure 4, the horizontal jacking cylinders 58,59 are actuated in an opposite direction, this time pulling the lift and roll jack 43 in a sliding manner against the platens back to its original position with respect to the plate 60, similar to the position shown in FIG. 5B.

Figure 5D:
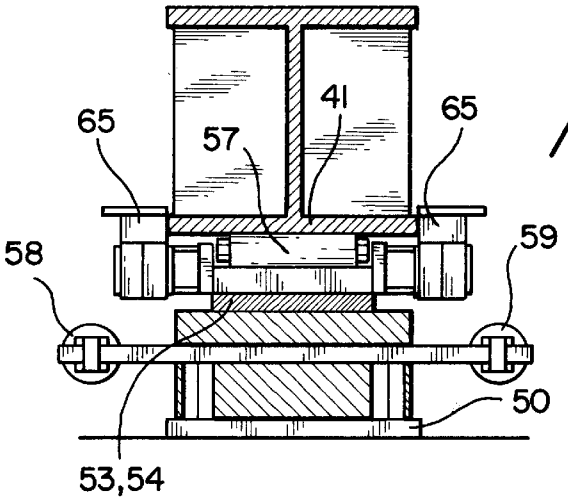
FIGS. 5D and 5E are end views of the lift and roll jacks of FIG. 5A in an engaged (jacked up) position and a disengaged (jacked down) position.
Figure 5E:
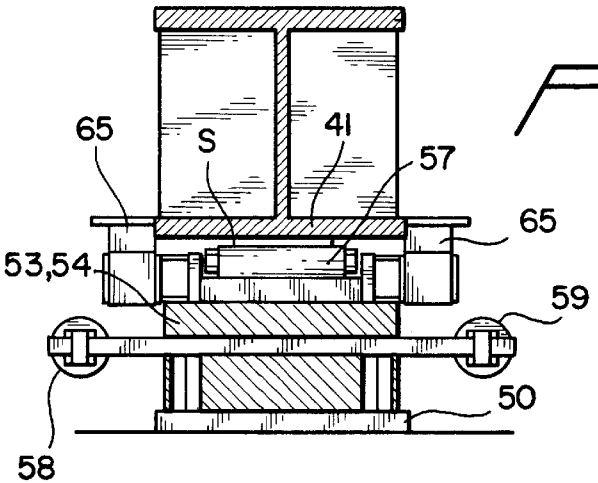

FIGS. 5D and 5E are end views of the lift and roll jack 43 showing the manner in which the vertical jacking cylinders 53,54 lift and lower the rollers 57 with respect to the walking beam 41. Note that when jacking cylinders 53,54 are raised, as shown in FIG. 5D, the rollers 57 are in contact with the walking beam 41 such that the weight of the substructure 4 is supported entirely by the jacks 43. When the jacking cylinders 53,54 are lowered, as shown in FIG. 5E, a space S exists between the rollers 57 and the walking beam 41 as the walking beam 41 is supported by the platens. To assist in guiding the walking beam 41 along its path during a move, a plurality of guide members 65 extend from the jacks 43 on each side of walking beam 41, as shown best in FIGS. 5D and 5E. In a preferred embodiment, such guide members 65 may comprise rollers or similar bearing structures which maintain the walking beam 41 centered on the rolling rack 55.

As can now be appreciated, the entire substructure 4 may be repositioned by conducting several of the foregoing incremental moves until the substructure 4 is over the appropriate well site. Specifically, the transverse walking beams 41,42 are moved relative to the platens in accordance with the aforementioned procedure employing a preferred total of eight (8) such lift and roll jacks 43 operated simultaneously, with two such jacks 43 underneath each of the four legs of the substructure 4, as shown in FIG. 4. Likewise, the longitudinal walking beams 44,45 are similarly moved with respect to the transverse walking beams 41,42 by a preferred total of four identical longitudinal lift and roll jacks 47 operated simultaneously, also depicted in FIG. 4. Thus, to reposition the entire substructure 4 to a different well location, the substructure 4 is first moved in either the transverse or the longitudinal direction, after which it is moved in the perpendicular direction. Although not required, it is preferred that the lift and roll jacks 43,47 be alternately oriented, as depicted in FIG. 4, meaning that when the substructure 4 is moved in a particular direction, half of the jacks are pushing while an equal number are pulling. Such an alternating orientation allows for a more uniform movement of the substructure 4 in addition to ensuring that the same forces are applied to move the substructure 4 in either direction.

Figure 6A:
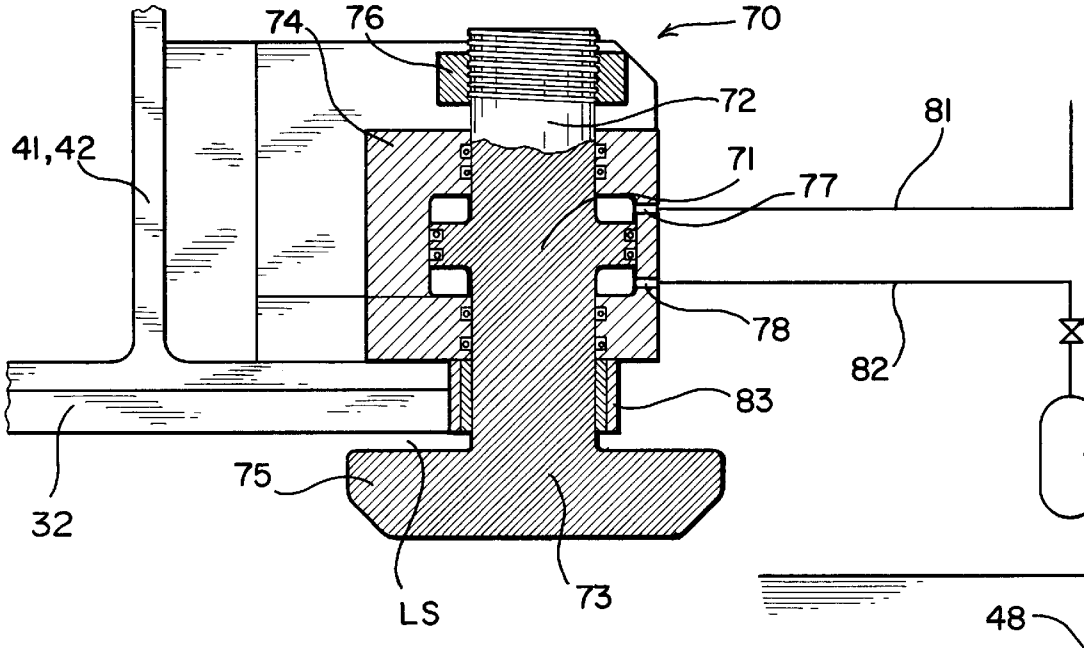
FIG. 6A is a sectional view of the clamping device used in connection with the movable substructure.
Figure 6B:
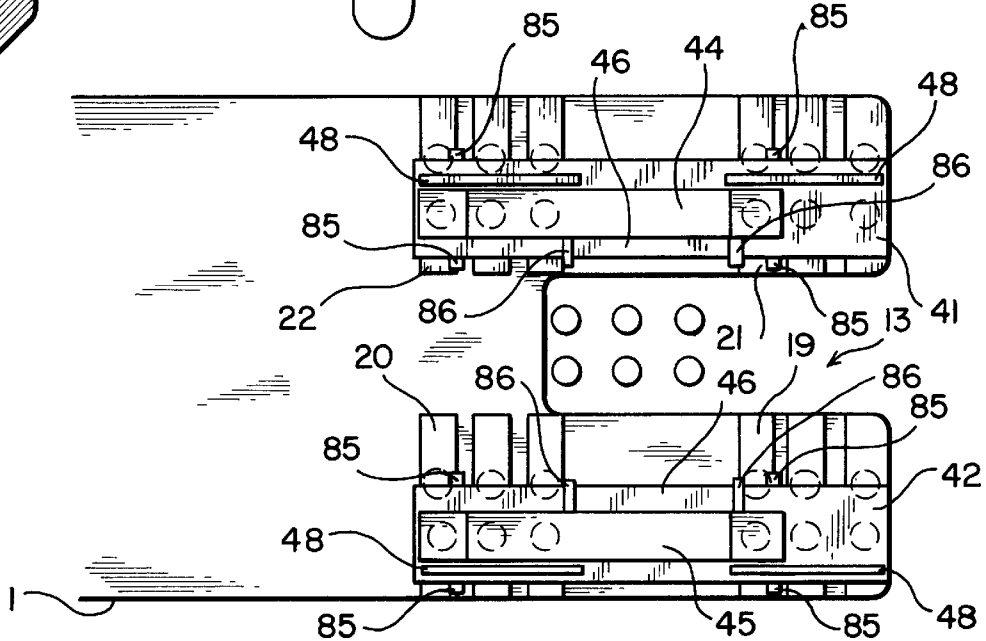
FIG. 6B is a top view of the clamping locations for both the transverse and longitudinal walking beams.

FIG. 6A is a sectional view of the clamping assembly 70 employed with the movable substructure 4 which secures its position after each incremental move. Shown in relation to one of the transverse walking beams 41,42, the clamping system 70 preferably comprises a double-acting hydraulic piston 71 having an externally threaded upper end 72 and a lower end 73, slidably disposed within an outer cylinder 74 attached to walking beam 41. Lower end 73 includes a lip 75 which extends underneath the horizontal plate 32 of the platen 19, while the upper end 72 includes a locking nut 76 threadably attached thereto. Cylinder 74 includes ports 77,78 to which hydraulic lines 81,82 attach for operation of the clamp 70 using hydraulic controls in a manner understood to those of ordinary skill in the industry. For reasons which will become clearer below, the hydraulic control system for the clamps 70 is interconnected to the hydraulic control system for the jacks 43,47. A nitrogen backup system 80 and relief valve 79 are also fluidically connected to hydraulic line 82 to ensure a secure clamping condition in the event of failure of the usual hydraulic control system. As an additional means of guiding the walking beam 41 with respect to the platens, a roller 83 with appropriate bearings 84 is affixed to lower end 73 which provides rolling contact against the walking beam 41 and the platen 19. In operation of the clamp 70, the piston 71 is actuated in a downward direction simultaneously with the operation of the vertical jacking cylinders 53,54 to lift the walking beams 41,42, thus releasing the walking beams 41,42 for movement relative to the platens by creating a lift space LS slightly greater than the distance D that walking beams 41,42 are lifted. As the vertical jacking cylinders 53,54 are lowered after the incremental move, the piston 71 is simultaneously raised to secure the walking beams 41,42 to the platens once again. Therefore, the walking beams 41,42 are always clamped to the platens when there is no motion of the substructure 4. Once the desired repositioning has taken place through a series of incremental moves as previously explained, the clamp 70 is locked into place by tightening the locking nut 76 against cylinder 74. Although the foregoing structure and operation of the clamping system 70 has been described with regard to the motion between transverse walking beams 41,42 and the platens, an identical arrangement exists between longitudinal walking beams 44,45 and transverse walking beams 41,42. Preferably, each of transverse walking beams 41,42 includes at least four such clamping systems 70, with two on either side of each walking beam 41,42, as shown by clamping locations 85 in FIG. 6B. A similar arrangement of two such clamping systems 70 exists for each of the longitudinal walking beams 44,45, shown at locations 86.

Figure 7A:
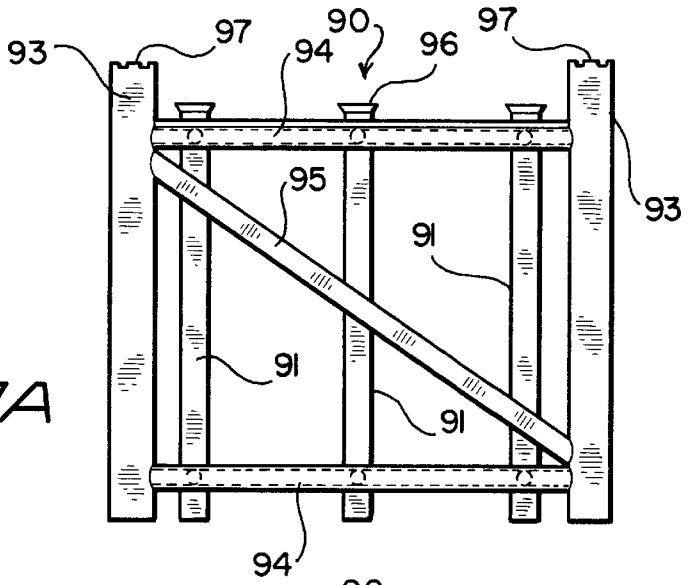
FIG. 7A is a side view of a proposed well protect structure used to drill multiple wells from a single barge location.
Figure 7B:
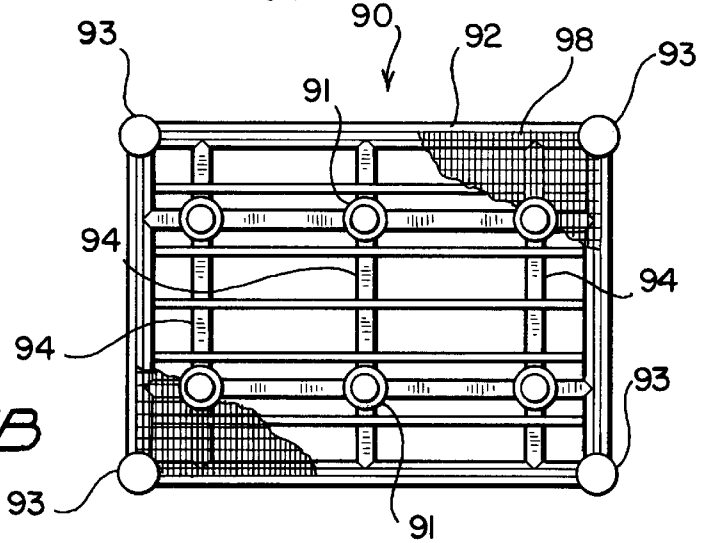
FIG. 7B is a top view of the well protect structure of FIG. 7A.

FIG. 7A and 7B illustrate a well protect structure 90 for use in connection with the present invention. Because of the ability of the substructure 4 to move from well to well, the single-well protective structures that are normally employed with barge drilling operations are not suitable. Therefore, the well protect structure 90 includes a plurality of hollow, well protective columns 91 through which casing and drill pipe may be passed. Each of the protective columns 91 are connected to one another by an outer frame 92 comprising four vertical support posts 93 and appropriate horizontal support elements 94 and diagonal support elements 95. The pattern of columns 91 is identical to the pattern of wells that may be drilled by the repositioning of the movable substructure 4. Each of the columns 91 includes an upper divergent opening 96 in the form of an inverted cone so that drill pipe may be easily guided into the columns 91. For reasons which will become clearer below, each of the vertical support posts 93 includes an upper opening 97 which allows for the insertion and attachment of a novel protective deck 100. Finally, a grating deck 98 extends across the upper level of the well protect structure 90 to provide a surface for the movement of crew members.

Figure 8A:
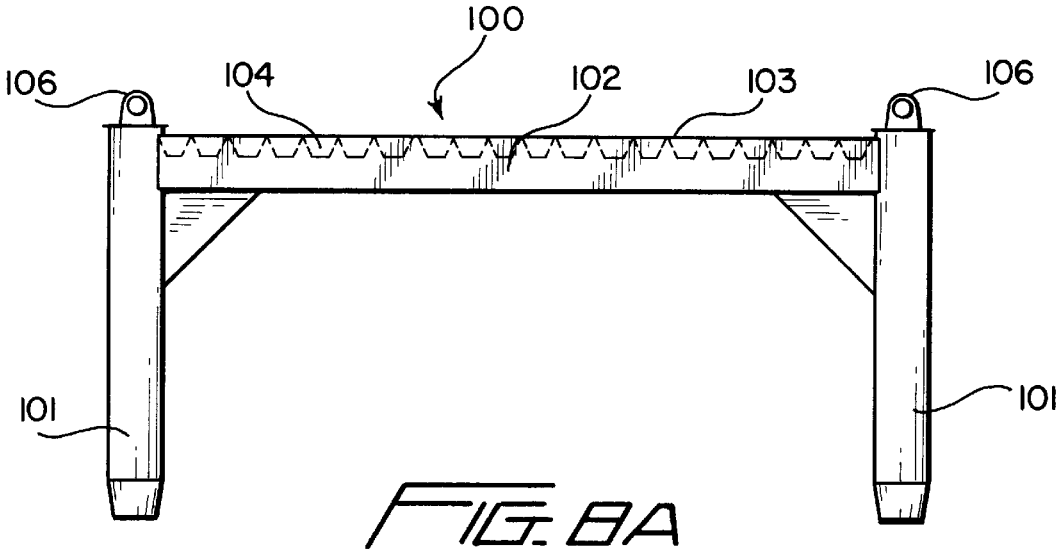
FIG. 8A is a side view of a proposed protective deck used in connection with the well protect structure.
Figure 8B:
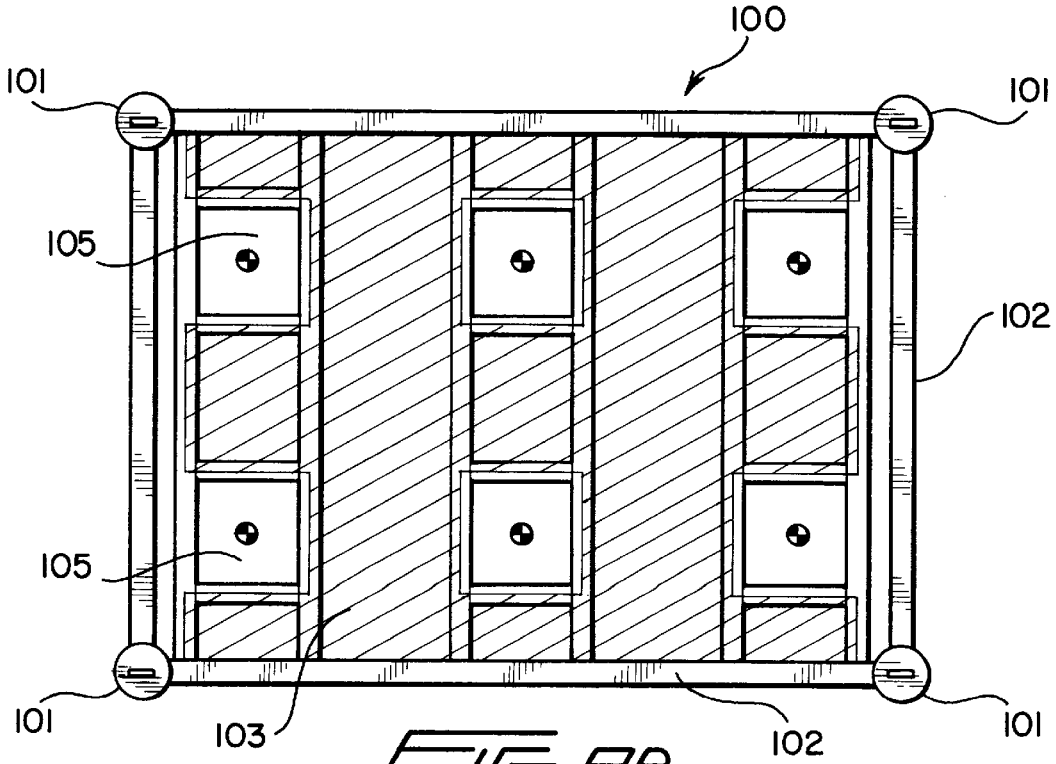
FIG. 8B is a top view of the protective deck of FIG. 8A.
Figure 8C:
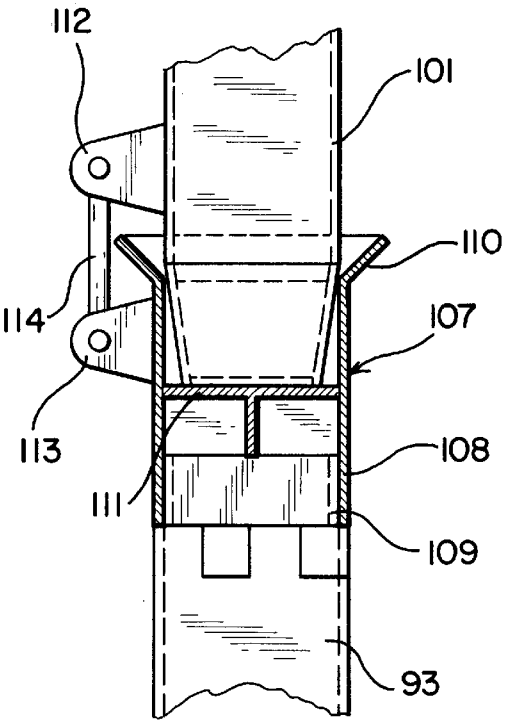
FIG. 8C is a detailed view of the connection between the protective deck and the well protect structure.

FIG. 8A and 8B illustrate a novel design for a protective deck 100 that can be used with the present invention and the aforedescribed well protect structure 90. Similar to the well protect structure 90, the protective deck 100 includes four support posts 101 interconnected to one another by a frame 102. Support posts 101 are tapered at the bottoms for insertion into the upper openings 97 of the support posts 93 of the well protect structure 90, as shown in FIG. 8C. The deck surface 103 comprises steel sheet, preferably ¾ inch in thickness, and is strengthened underneath by a series of side-by-side steel stiffeners 104 extending across the frame 102. The deck surface 103 extends completely across the protective deck 100 from each side of frame 102 except for apertures 105 in the same pattern as the columns 91 of the well protect structure 90. Each of the four support posts 101 includes a lifting lug 106 which are used to lower the protective deck 100 onto the well protect structure 90 prior to drilling operations. In FIG. 8C, the illustration depicts the manner in which the support posts 101 of the protective deck 100 are removably attached to the support posts 93 of the well protect structure 90. An adaptor 107 is welded to the upper opening of the support posts 93 of the well protect structure 90 to allow the connection to the protective deck 100. The adaptor 107 comprises a sleeve 108 which is welded to a piling 109 driven into the ground through support post 93. An upper divergent flange 110 is provided to accept the tapered end of support post 101 of the protective deck 100, while a stop plate 111 welded to the inside of sleeve 108 provides a surface upon which the support post 101 rests. Attachment lugs 112,113 are welded to each of support post 93 and support post 101 so that a connection member 114 can be removably attached therebetween.

Figure 9:
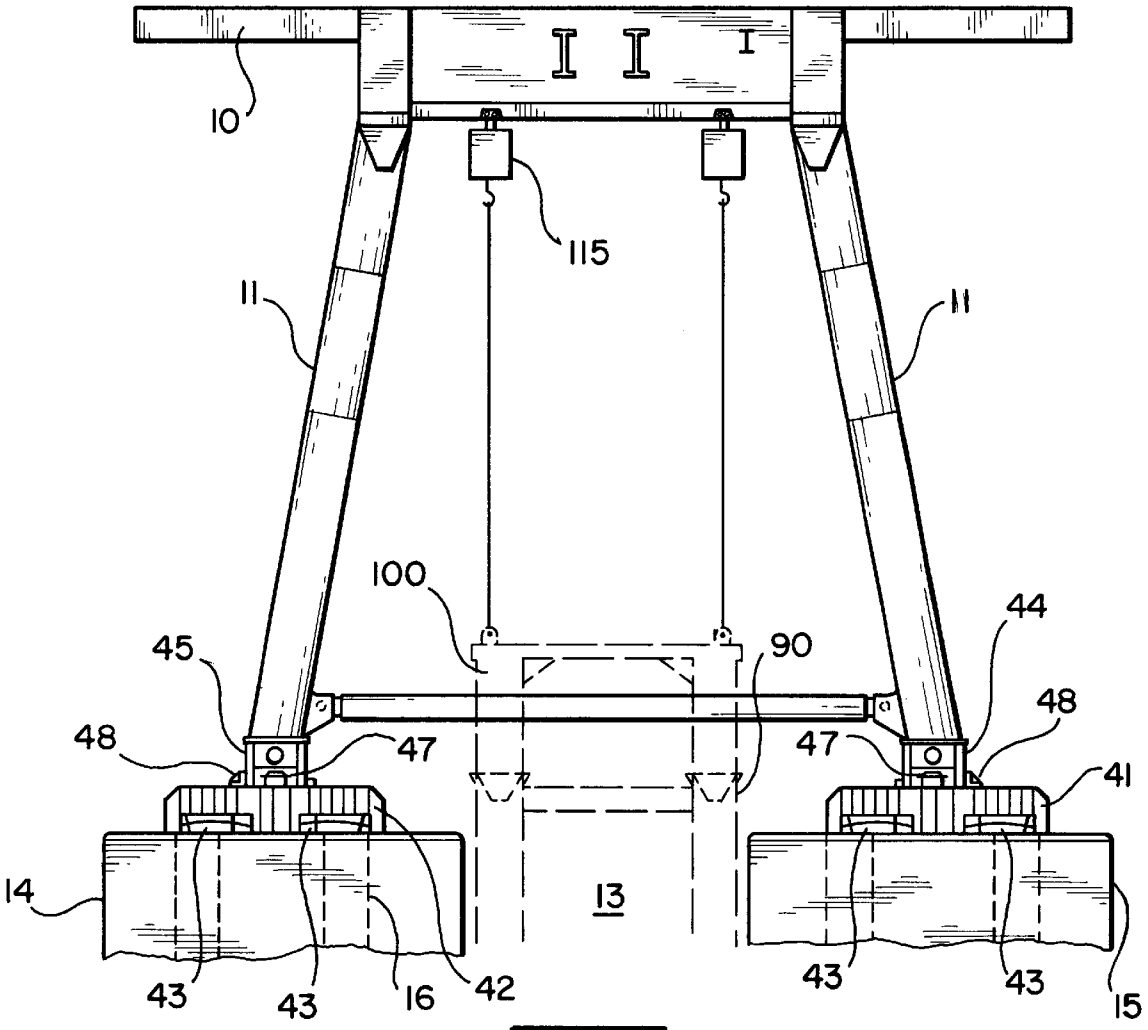
FIG. 9 is a side view of the assembly of the well protect structure and the protective deck in use with a vessel having a movable substructure.

FIG. 9 illustrates the assembly of the well protect structure 90 and the protective deck 100 in use with a vessel 1 having a movable substructure 4. The well protect structure 90 is first set into the ground in the manner common in barge drilling operations, after which the barge 1 backs against the well protect structure 90 so that it resides within the keyway 13. Next, the protective deck 100 is lowered by a hoist system 115 located beneath the drill floor 10, and is then connected in the manner just described.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. A movable structure for use in drilling operations, comprising:

(a) a drilling platform, including a plurality of downwardly extending support members attached thereto;

(b) a base below said drilling platform having means for securely supporting the weight and position of said drilling platform; and (c) repositioning means, operatively connected between said support members and said base, for moving said drilling platform in a predetermined direction relative to said base.

2. The movable structure of claim 1, wherein said base comprises a buoyant vessel adapted to make stable contact with the ground.

3. The movable structure of claim 1, wherein said repositioning means includes:

(a) at least two horizontal and parallel beams attached to said support legs; and (b) means for allowing said beams to be moved in unison relative to said base.

4. The movable structure of claim 3, wherein said means for allowing said beams to be moved comprises a plurality of lift and roll jacking assemblies, wherein each of said jacking assemblies includes:

(a) a mounting portion in contact with said base;

(b) a jacking element connected to said mounting portion, wherein said jacking element is adapted to lift said beam in a vertical direction away from said base;

(c) a rolling element connected to said jacking element; and (d) a force applying element connected to said mounting portion adapted to move said beam over said rolling element relative to said jacking assembly when said beam is lifted by said jacking element.

5. The movable structure of claim 1, wherein said repositioning means comprises:

(a) a transverse repositioning device for movement of said drilling platform in a port or starboard direction; and (b) a longitudinal repositioning device for movement of said drilling platform in a bow or stern direction.

6. The movable structure of claim 5, wherein said longitudinal repositioning device is connected to said support legs of said drilling structure, and wherein said longitudinal repositioning device resides above and moves relative to said transverse repositioning device.

7. The movable structure of claim 6, wherein:

(a) said transverse repositioning device includes at least two horizontal and parallel transverse beams in contact with said base;

(b) said longitudinal repositioning device includes at least two horizontal and parallel longitudinal beams connected to opposing pairs of said support legs of said drilling structure, and wherein said longitudinal beams are parallel to and in contact with said transverse beams;

(c) said transverse repositioning device includes a plurality of lift and roll transverse jacking assemblies operatively in contact between said transverse beams and said base; and (d) said longitudinal repositioning device includes a plurality of lift and roll longitudinal jacking assemblies operatively in contact between said longitudinal beams and said transverse beams.

8. The movable structure of claim 7, wherein each of said transverse jacking assemblies includes:

(a) a mounting portion in contact with said base;

(b) a jacking element connected to said mounting portion, wherein said jacking element is adapted to lift said transverse beam in a vertical direction away from said base;

(c) a rolling element connected to said jacking element; and (d) a force applying element connected to said mounting portion adapted to move said transverse beam over said rolling element relative to said jacking assembly when said transverse beam is lifted by said jacking element.

9. The movable structure of claim 7, wherein each of said longitudinal jacking assemblies includes:

(a) a mounting portion in contact with an upper surface of said transverse beam;

(b) a jacking element connected to said mounting portion, wherein said jacking element is adapted to lift said longitudinal beam in a vertical direction away from said transverse beam;

(c) a rolling element connected to said jacking element; and (d) a force applying element connected to said mounting portion adapted to move said longitudinal beam over said rolling element relative to said jacking assembly when said longitudinal beam is lifted by said jacking element.

10. The movable structure of claim 6, further comprising:

(a) transverse clamping means operatively connected between said base and said transverse repositioning device for securing the position of said transverse repositioning device relative to said base between repositioning operations; and (b) longitudinal clamping means operatively connected between said transverse repositioning device and said longitudinal repositioning device for securing the position of said longitudinal repositioning device relative to said transverse repositioning device between repositioning operations.

11. The movable structure of claim 1, further comprising clamping means operatively connected between said base and said repositioning means for securing the position of said drilling platform relative to said base between repositioning operations.

12. A drilling vessel for selectively drilling two or more wells from a single location of said vessel, comprising:

(a) a buoyant hull having a deck, including ballasting means in said hull for allowing said vessel to be stabilized on the bottom surface of a body of water;

(b) a movable substructure in contact with said deck, wherein said movable substructure includes:

(i) a drilling platform having a plurality of downwardly extending support legs attached thereto, wherein the height of said drilling platform from said deck is sufficient to allow simultaneous drilling and production activities to occur; and (ii) repositioning means, operatively connected between said support members and said deck, for moving said drilling platform in a predetermined direction relative to said deck.

13. The drilling vessel of claim 12, wherein said repositioning means includes:

(a) at least two horizontal and parallel beams attached to said support legs; and (b) means for allowing said beams to be moved in unison relative to said deck.

14. The drilling vessel of claim 13, wherein said means for allowing said beams to be moved comprises a plurality of lift and roll jacking assemblies, wherein each of said jacking assemblies includes:

(a) a mounting portion in contact with said deck;

(b) a jacking element connected to said mounting portion, wherein said jacking element is adapted to lift said beam in a vertical direction away from said deck;

(c) a rolling element connected to said jacking element; and (d) a force applying element connected to said mounting portion adapted to move said beam over said rolling element relative to said jacking assembly when said beam is lifted by said jacking element.

15. The drilling vessel of claim 12, wherein said repositioning means comprises:

(a) a transverse repositioning device for movement of said drilling platform in a port or starboard direction; and (b) a longitudinal repositioning device for movement of said drilling platform in a bow or stern direction.

16. The drilling vessel of claim 15, wherein said longitudinal repositioning device is connected to said support legs of said drilling platform, and wherein said longitudinal repositioning device resides above and moves relative to said transverse repositioning device.

17. The drilling vessel of claim 16, wherein:

(a) said transverse repositioning device includes at least two horizontal and parallel transverse beams in contact with said deck;

(b) said longitudinal repositioning device includes at least two horizontal and parallel longitudinal beams connected to opposing pairs of said support legs of said drilling platform, and wherein said longitudinal beams are parallel to and in contact with said transverse beams;

(c) said transverse repositioning device includes a plurality of lift and roll transverse jacking assemblies operatively in contact between said transverse beams and said deck; and (d) said longitudinal repositioning device includes a plurality of lift and roll longitudinal jacking assemblies operatively in contact between said longitudinal beams and said transverse beams.

18. The drilling vessel of claim 17, wherein each of said transverse jacking assemblies includes:

(a) a mounting portion in contact with said deck;

(b) a jacking element connected to said mounting portion, wherein said jacking element is adapted to lift said transverse beam in a vertical direction away from said deck;

(c) a rolling element connected to said jacking element; and (d) a force applying element connected to said mounting portion adapted to move said transverse beam over said rolling element relative to said jacking assembly when said transverse beam is lifted by said jacking element.

19. The drilling vessel of claim 17, wherein each of said longitudinal jacking assemblies includes:

(a) a mounting portion in contact with an upper surface of said transverse beam;

(b) a jacking element connected to said mounting portion, wherein said jacking element is adapted to lift said longitudinal beam in a vertical direction away from said transverse beam;

(c) a rolling element connected to said jacking element; and (d) a force applying element connected to said mounting portion adapted to move said longitudinal beam over said rolling element relative to said jacking assembly when said longitudinal beam is lifted by said jacking element.

20. The drilling vessel of claim 17, further comprising:

(a) two or more platens constructed onto said deck beneath said repositioning means, wherein said platens are sized and dimensioned to provide a bearing surface for said drilling platform and said transverse beams, and wherein each of said platens includes a first horizontally extending flange; and (b) second horizontally extending flanges connected to each of said transverse beams.

21. The drilling vessel of claim 20, further comprising:

(a) transverse clamping means operatively connected to said transverse beams and matably engageable with said first horizontally extending flanges of said platens for securing the position of said transverse beams relative to said deck between repositioning operations; and (b) longitudinal clamping means operatively connected to said longitudinal beams and matably engageable with said second horizontally extending flanges of said transverse beams for securing the position of said longitudinal beams relative to said transverse beams between repositioning operations.

22. The drilling vessel of claim 12, further comprising two or more platens constructed onto said deck beneath said repositioning means, wherein said platens are sized and dimensioned to provide a bearing surface for said movable substructure, and wherein each of said platens includes a horizontally extending flange.

23. The drilling vessel of claim 22, further comprising clamping means operatively connected to said repositioning means and matably engageable with said horizontally extending flanges of said platens for securing the position of said drilling platform relative to said deck between repositioning operations.

24. The drilling vessel of claim 12, wherein said hull further comprises:

(a) a plurality of support members rigidly connected within said hull below said movable substructure, such that said support legs of said drilling platform reside directly above said support members at any position of said movable substructure relative to said deck; and (b) a keyway formed into said hull sized and dimensioned to allow the drilling of multiple well locations corresponding to the position of said movable substructure.

25. The drilling vessel of claim 24, further comprising skating means constructed onto said deck and adjacent to said keyway for transporting equipment to and from a desired well.

26. The drilling vessel of claim 25, wherein said skating means comprises:

(a) a track member fixed relative to said deck and parallel to said keyway;

(b) a carrier matably engaged to said track member; and (c) rolling means disposed between said track member and said carrier for enabling smooth movement of said carrier relative to said track member.

27. A mobile drilling system, comprising:

(a) a buoyant vessel having a deck, said vessel including:

(i) a drilling platform movably mounted on said deck and movable relative to said vessel, wherein said movable drilling platform may be moved on said deck to enable drilling two or more wells from a single vessel location;

(ii) a keyway formed into said vessel through which drilling may occur;

(b) a well protect structure fixed in a waterbottom and operatively disposed in a fixed position within said keyway of said vessel, said well protect structure comprising two or more protective vertical members through which drilling may occur, the positions of said two or more protective vertical members defining a positional pattern for drilling of wells through said well protect structure, said drilling platform movable over each of said protective vertical members; and (c) a protective deck removably connectable to said well protect structure, said protective deck disposed above said well protect structure and below said drilling platform, said protective deck not connected to said drilling platform and thereby remaining in a fixed location when said drilling platform moves, wherein said protective deck includes a reinforced deck surface.

28. The mobile drilling system of claim 27, wherein said protective deck includes a plurality of apertures formed therein equal in number to said protective vertical members of said well protect structure.

* * * * *